US007070243B1

(12) United States Patent
Frank

(10) Patent No.: US 7,070,243 B1
(45) Date of Patent: Jul. 4, 2006

(54) BLOW MOLDED SIDE PANEL CHAIR SYSTEM

(76) Inventor: Donald R. Frank, 5516 SW. 1st La., Ocala, FL (US) 34474

( * ) Notice: Subject to any disclaimer, the term of this patent is extended or adjusted under 35 U.S.C. 154(b) by 29 days.

(21) Appl. No.: 10/783,067

(22) Filed: Feb. 20, 2004

(51) Int. Cl.
*A47C 7/02* (2006.01)

(52) U.S. Cl. ..... 297/452.18; 297/411.2; 297/451.11; 297/411.45; 297/452.14

(58) Field of Classification Search ..... 297/452.18, 297/411.2, 451.11, 411.25, 411.42, 411.45, 297/DIG. 4, DIG. 2, DIG. 10; 280/47.4, 280/47.38; 5/613, 617, 81.1 R, 86.1
See application file for complete search history.

(56) References Cited

U.S. PATENT DOCUMENTS 3,635,526 A * 1/1972 Posey ..... 297/488
3,640,571 A * 2/1972 Keropian ..... 297/464
4,183,578 A * 1/1980 Naganawa ..... 297/90
4,343,482 A * 8/1982 Wegner ..... 280/42
4,350,227 A * 9/1982 Knoche ..... 188/2 F
4,643,481 A * 2/1987 Saloff et al. ..... 297/452.25
4,770,432 A * 9/1988 Wagner ..... 280/250.1
4,770,467 A * 9/1988 Zinn ..... 297/423.37
5,823,548 A * 10/1998 Reiland et al. ..... 280/33.993

* cited by examiner

*Primary Examiner*—Laurie K. Cranmer
(74) *Attorney, Agent, or Firm*—Edward P. Dutkiewicz

(57) ABSTRACT

A frame has a pair of laterally spaced tubular supports in a generally inverted U-shaped configuration. A seat panel, in a generally horizontal plane, is secured between the supports. A back panel is supported by the seat panel. A pair of side panels includes one panel coupled to each tubular support. Each panel has an interior wall and an exterior wall. A periphery is provided between the walls. Each exterior wall has a continuous recess congruent with its periphery. The interior wall of each side panel has a discontinuous recess. An inverted U-shaped component extends above the seat panel and a horizontal component is below the seat panel.

4 Claims, 3 Drawing Sheets

FIG 5
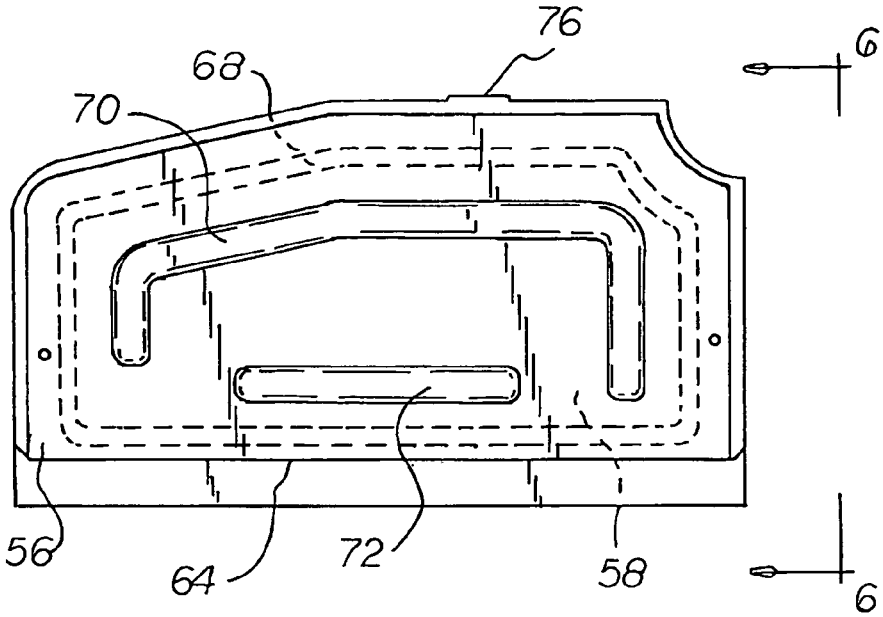
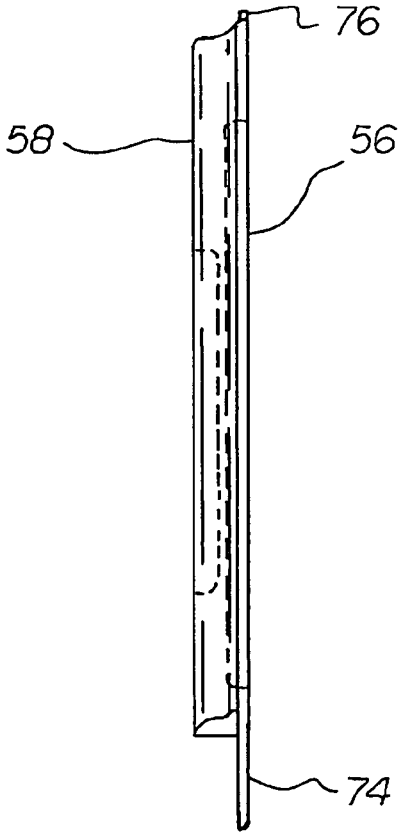
FIG 6

BLOW MOLDED SIDE PANEL CHAIR SYSTEM

BACKGROUND OF THE INVENTION

1. Field of the Invention

The present invention relates to a blow molded side panel chair system and more particularly pertains to maximizing the safety, strength and durability of a chair system while minimizing its cost and weight.

2. Description of the Prior Art

The use of chairs of known designs and configurations is known in the prior art. More specifically, chairs of known designs and configurations previously devised and utilized for the purpose of fabricating chairs by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,666,505 issued Dec. 23, 2003 to Greger relates to a reclining child seat and U.S. Pat. No. 4,854,638 issued Aug. 8, 1889 to Marcus relates to a portable adjustable child's seat.

While these devices fulfill their respective, particular objectives and requirements, the aforementioned patents do not describe a blow molded side panel chair system that allows maximizing the safety, strength and durability of a chair system while minimizing its cost and weight.

In this respect, the blow molded side panel chair system according to the present invention substantially departs from the conventional concepts and designs of the prior art, and in doing so provides an apparatus primarily developed for the purpose of maximizing the safety, strength and durability of a chair system while minimizing its cost and weight.

Therefore, it can be appreciated that there exists a continuing need for a new and improved blow molded side panel chair system which can be used for maximizing the safety, strength and durability of a chair system while minimizing its cost and weight. In this regard, the present invention substantially fulfills this need.

SUMMARY OF THE INVENTION

In view of the foregoing disadvantages inherent in the known types of chairs of known designs and configurations now present in the prior art, the present invention provides an improved blow molded side panel chair system. As such, the general purpose of the present invention, which will be described subsequently in greater detail, is to provide a new and improved blow molded side panel chair system and method which has all the advantages of the prior art and none of the disadvantages.

To attain this, the present invention essentially comprises a metallic frame. The metallic frame has a pair of laterally spaced tubular supports. The supports are in a generally inverted U-shaped configuration. Each support has a forward vertical section. The forward vertical section has a lower end. Each support has a rearward vertical section. The rearward vertical section has a lower end. An upper intermediate section is provided between the forward and reward vertical sections. The upper intermediate section includes a leading section. The leading section is in a generally horizontal orientation. The upper intermediate section includes a trailing section. The trailing section is in an angular orientation between the leading section and the rearward vertical section.

A forward wheel is provided. The forward wheel is provided on a caster at the lower end of each forward vertical section. A rearward wheel is provided. The rearward wheel is provided on a caster at the lower end of each rearward vertical section.

Provided next is a seat panel. The seat panel is provided in a generally horizontal plane. The seat panel has a front edge and a rear edge fixedly secured between the supports. In this manner a user may be received.

A back panel is provided. The back panel has an upper edge and a lower edge. The back panel is pivotally supported by the seat panel adjacent to the rear edge. A bracket assembly is provided. The bracket assembly retains the back panel at any of a plurality of preselected angular orientations.

Laterally displaced handles are provided. The handle have lower ends. The lower ends are secured to the frame. The handle also has upper ends. The upper ends are adapted to be held by a care giver in pushing the system and a user supported thereby.

A supplemental tube is provided next. The tube is laterally spaced outwardly from each leading section of the frame. In this manner a tray is supported.

Further provided is a pair of panels. The panels are blow molded from an elastomeric material. The elastomeric material is selected from the class of elastomers. The class of elastomers includes plastic and rubber, natural and synthetic, and blends thereof. The material is preferably polyethylene. The pair of panels includes one panel for each tubular support. Each panel has an interior vertical wall. The interior vertical wall is adjacent to the seat. A laterally spaced exterior wall is provided next. The exterior wall is remote from the seat. A periphery is provided between the interior and exterior walls. Each periphery has a concave profile. The concave profile receives the vertical sections and intermediate section of an adjacent tubular support. A horizontal profile is provided beneath the intermediate section. An arcuate recess is provided. The arcuate recess is provided adjacent to the forward vertical support and the horizontal support. The exterior wall of the side panel has a continuous recess. The continuous recess is congruent with the periphery of its panel. The continuous recess extends toward the interior wall. The interior wall of the side panel has a discontinuous recess. An inverted U-shaped component is provided. The inverted U-shaped component extends above the seat panel. A horizontal component is provided. The horizontal component is provided below the seat panel. The horizontal component extends toward the exterior wall. In this manner the safety, strength and durability of the system are maximized while minimizing its cost and weight. Each panel includes an elongated extension. The elongated extension extends downwardly from the entire length of the interior wall. Each panel includes a shortened extension. The shortened extension extends upwardly from the interior wall between a portion of the leading and intermediate sections of its frame.

Provided last is a pair of metallic tabs for each side panel. Each tab has a first end. The first end is welded to an associated vertical section of its tubular support. Each tab has a second end. The second end has an aperture and a screw. The screw and aperture couple the tab and tubular support to its side panel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved blow molded side panel chair system which has all of the advantages of the prior art chairs of known designs and configurations and none of the disadvantages.

It is another object of the present invention to provide a new and improved blow molded side panel chair system which may be easily and efficiently manufactured and marketed.

It is further object of the present invention to provide a new and improved blow molded side panel chair system which is of durable and reliable constructions.

An even further object of the present invention is to provide a new and improved blow molded side panel chair system which is susceptible of a low cost of manufacture with regard to both materials and labor, and which accordingly is then susceptible of low prices of sale to the consuming public, thereby making such blow molded side panel chair system economically available to the buying public.

Even still another object of the present invention is to provide a blow molded side panel chair system for maximizing the safety, strength and durability of a chair system while minimizing its cost and weight.

Lastly, it is an object of the present invention to provide a new and improved blow molded side panel chair system. A frame has a pair of laterally spaced tubular supports in a generally inverted U-shaped configuration. A seat panel, in a generally horizontal plane, is secured between the supports. A back panel is supported by the seat panel. A pair of side panels includes one panel coupled to each tubular support. Each panel has an interior wall and an exterior wall. A periphery is provided between the walls. Each exterior wall has a continuous recess congruent with its periphery. The interior wall of each side panel has a discontinuous recess. An inverted U-shaped component extends above the seat panel and a horizontal component is below the seat panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front elevational view of one of the panels of the system.

FIG. 6 is an end elevational view of a panel taken along line 6—6 of FIG. 5.

The same reference numerals refer to the same parts throughout the various Figures.

DESCRIPTION OF THE PREFERRED EMBODIMENT

Figure 1:
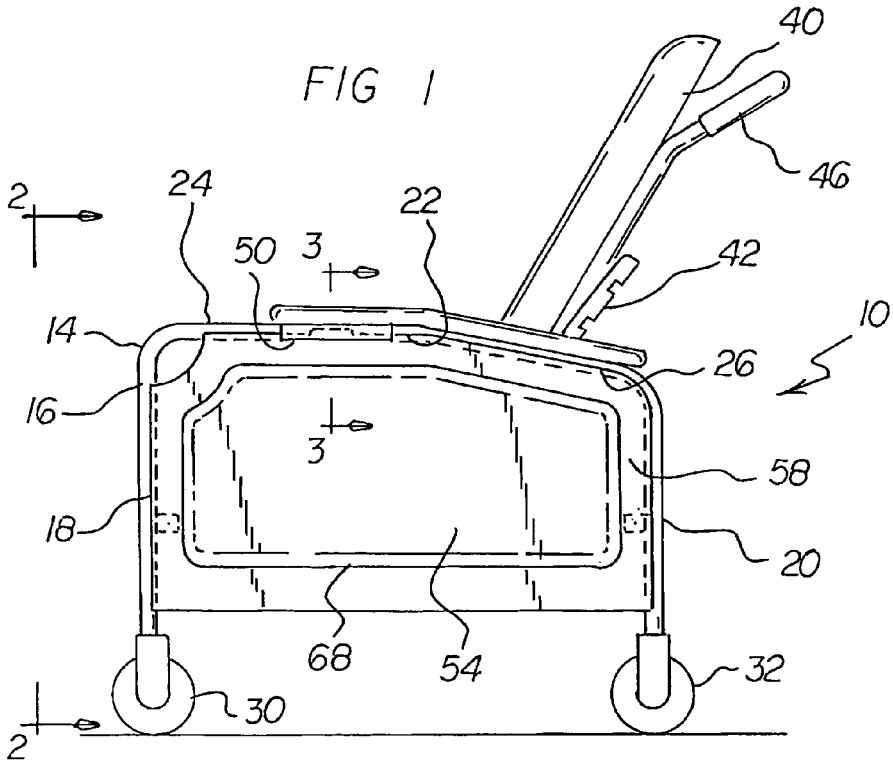
FIG. 1 is a side elevational view of a blow molded side panel chair system constructed in accordance with the principles of the present invention.
Figure 2:
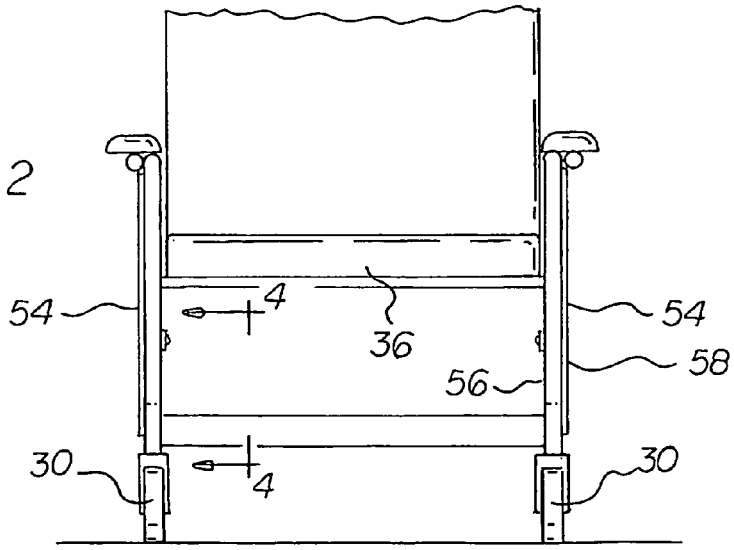
FIG. 2 is a front elevational view of the system taken along line 2—2 of FIG. 1.
Figure 3:
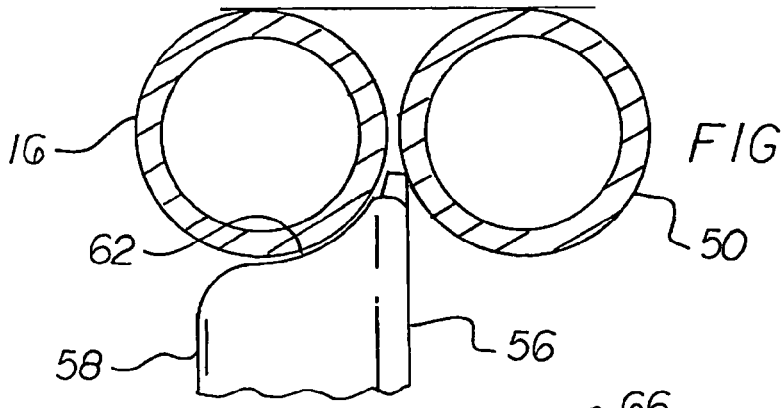
FIG. 3 is a cross sectional view of the system taken along line 3—3 of FIG. 1.
Figure 4:
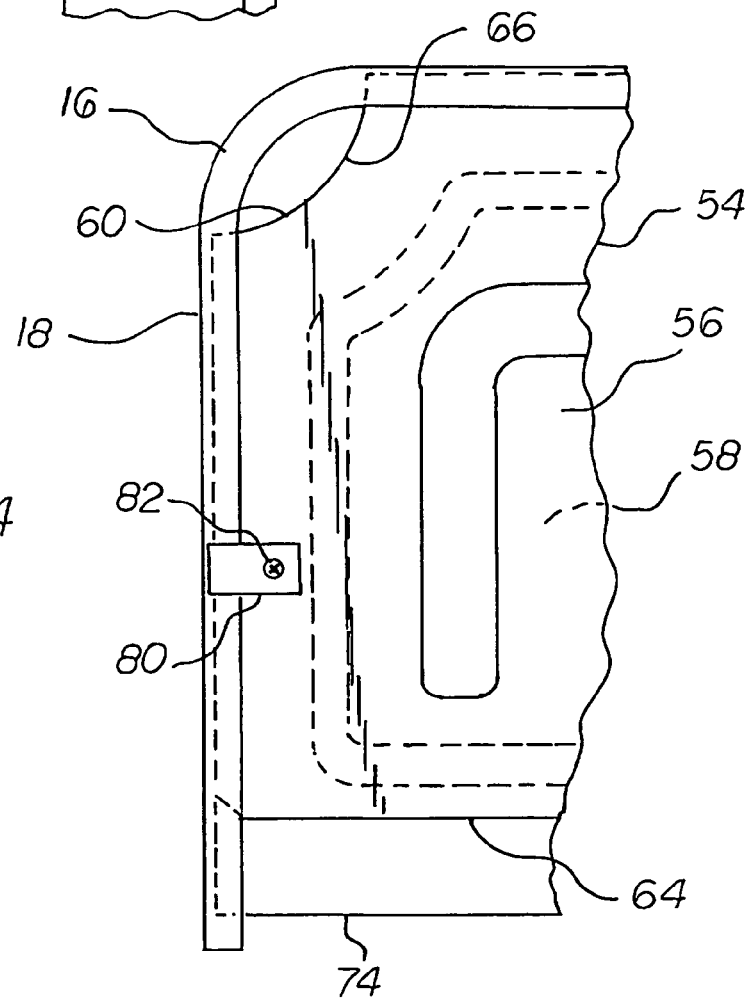
FIG. 4 is a partial side elevational view of the system taken along line 4—4 of FIG. 2.

With reference now to the drawings, and in particular to FIG. 1 thereof, the preferred embodiment of the new and improved blow molded side panel chair system embodying the principles and concepts of the present invention and generally designated by the reference numeral 10 will be described.

The present invention, the blow molded side panel chair system 10 is comprised of a plurality of components. Such components in their broadest context include a frame, a seat panel, a back panel and a pair of side panels. Such components are individually configured and correlated with respect to each other so as to attain the desired objective.

First provided is a metallic frame 14. The metallic frame has a pair of laterally spaced tubular supports 16. The supports are in a generally inverted U-shaped configuration. Each support has a forward vertical section 18. The forward vertical section has a lower end. Each support has a rearward vertical section 20. The rearward vertical section has a lower end. An upper intermediate section 22 is provided between the forward and reward vertical sections. The upper intermediate section 22 includes a leading section 24. The leading section is in a generally horizontal orientation. The upper intermediate section includes a trailing section 26. The trailing section is in an angular orientation between the leading section and the rearward vertical section.

A forward wheel 30 is provided. The forward wheel is provided on a caster at the lower end of each forward vertical section. A rearward wheel 32 is provided. The rearward wheel is provided on a caster at the lower end of each rearward vertical section.

Provided next is a seat panel 36. The seat panel is provided in a generally horizontal plane. The seat panel has a front edge and a rear edge fixedly secured between the supports. In this manner a user may be received.

A back panel 40 is provided. The back panel has an upper edge and a lower edge. The back panel is pivotally supported by the seat panel adjacent to the rear edge. A bracket assembly 42 is provided. The bracket assembly retains the back panel at any of a plurality of preselected angular orientations.

Laterally displaced handles 46 are provided. The handle have lower ends. The lower ends are secured to the frame. The handle also has upper ends. The upper ends are adapted to be held by a care giver in pushing the system and a user supported thereby.

A supplemental tube 50 is provided next. The tube is laterally spaced outwardly from each leading section of the frame. In this manner a tray is supported.

Further provided is a pair of panels 54. The panels are blow molded from an elastomeric material. The elastomeric material is selected from the class of elastomers. The class of elastomers includes plastic and rubber, natural and synthetic, and blends thereof. The material is preferably polyethylene. The pair of panels includes one panel for each tubular support. Each panel has an interior vertical wall 56. The interior vertical wall is adjacent to the seat. A laterally spaced exterior wall 58 is provided next. The exterior wall is remote from the seat. A periphery 60 is provided between the interior and exterior walls. Each periphery has a concave profile 62. The concave profile receives the vertical sections and intermediate section of an adjacent tubular support. A horizontal profile 64 is provided beneath the intermediate section. An arcuate recess 66 is provided. The arcuate recess is provided adjacent to the forward vertical support and the horizontal support. The exterior wall of the side panel has a continuous recess 68. The continuous recess is congruent with the periphery of its panel. The continuous recess extends toward the interior wall. The interior wall of the side panel has a discontinuous recess. An inverted U-shaped component 70 is provided. The inverted U-shaped component extends above the seat panel. A horizontal component 72 is provided. The horizontal component is provided below the seat panel. The horizontal component extends toward the exterior wall. In this manner the safety, strength and durability of the system are maximized while minimizing its cost and weight. Each panel includes an elongated extension 74. The elongated extension extends downwardly from the entire length of the interior wall. Each panel includes a shortened extension 76. The shortened extension extends upwardly from the interior wall between a portion of the leading and intermediate sections of its frame.

Provided last is a pair of metallic tabs 80 for each side panel. Each tab has a first end. The first end is welded to an associated vertical section of its tubular support. Each tab has a second end. The second end has an aperture and a screw 82. The screw and aperture couple the tab and tubular support to its side panel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A blow molded side panel chair system for maximizing the safety, strength and durability of a chair system while minimizing its cost and weight comprising, in combination:

a metallic frame having a pair of laterally spaced tubular supports in a generally inverted U-shaped configuration, each support having a forward vertical section with a lower end and a rearward vertical section with a lower end and an upper intermediate section there between, the upper intermediate section including a leading section in a generally horizontal orientation and a trailing section in an angular orientation between the leading section and the rearward vertical section;

a seat panel in a generally horizontal plane with a front edge and a rear edge fixedly secured between the supports for the receipt of a user;

a back panel with an upper edge and a lower edge pivotally supported by the seat panel adjacent to the rear edge with a bracket assembly for retaining the back panel at any of a plurality of preselected angular orientations;

laterally displaced handles with lower ends secured to the frame and upper ends adapted to be held by a care giver in pushing the system and a user supported thereby;

a pair of panels blow molded from an elastomeric material, including one panel for each tubular support, each panel having an interior vertical wall adjacent to the seat and a laterally spaced exterior wall remote from the seat with a periphery there between, each periphery having a concave profile for the receipt of the vertical sections and intermediate section of an adjacent tubular support and a horizontal profile there beneath with an arcuate recess adjacent to the forward vertical support and the horizontal support, the exterior wall of the side panel having a continuous recess congruent with the periphery of its panel extending toward the interior wall, the interior wall of the side panel having a discontinuous recess with an inverted U-shaped component extending above the seat panel and a horizontal component below the seat panel extending toward the exterior wall for maximizing the safety, strength and durability of the system while minimizing its cost and weight, each panel including an elongated extension extending downwardly from the entire length of the interior wall, each panel including a shortened extension extending upwardly from the interior wall between a portion of the leading and intermediate sections of its frame; and a pair of metallic tabs for each side panel, each tab having a first end welded to an associated vertical section of its tubular support and a second end with an aperture and a screw to couple the tab and tubular support to its side panel.

2. A blow molded side panel chair system comprising:

a frame having a pair of laterally spaced tubular supports in a generally inverted U-shaped configuration wherein each tubular support has a leading section;

a seat panel in a generally horizontal plane secured between the supports;

a back panel supported by the seat panel; and a pair of blow molded side panels including one panel coupled to each tubular support, each panel having an interior wall and an exterior wall with a periphery there between, each exterior wall having a continuous recess congruent with its periphery, the interior wall of each side panel having a discontinuous recess with an inverted U-shaped component extending above the seat panel and a horizontal component below the seat panel, each panel further including an elongated extension extending downwardly from the entire length of the interior wall and each panel also includes a shortened extension extending upwardly from the interior wall.

3. The system as set forth in claim 2 and further including: a supplemental tube laterally spaced outwardly from each leading section of the frame adapted to selectively receive and support a tray.

4. The system as set forth in claim 2 wherein the side panels are blow molded from an elastomeric material.

* * * * *